US007588518B2

(12) United States Patent
LaStayo et al.

(10) Patent No.: US 7,588,518 B2
(45) Date of Patent: Sep. 15, 2009

(54) METHOD AND APPARATUS FOR TORQUE-CONTROLLED ECCENTRIC EXERCISE TRAINING

(75) Inventors: Paul LaStayo, Flagstaff, AZ (US); Stan Lindstedt, Flagstaff, AZ (US); Hans Hoppeler, Bolligen (CH)

(73) Assignee: Arizona Board of Regents

( * ) Notice: Subject to any disclaimer, the term of this patent is extended or adjusted under 35 U.S.C. 154(b) by 574 days.

(21) Appl. No.: 10/203,909

(22) PCT Filed: Feb. 28, 2001

(86) PCT No.: PCT/US01/06660

§ 371 (c)(1),
(2), (4) Date: Oct. 29, 2002

(87) PCT Pub. No.: WO01/64297

PCT Pub. Date: Sep. 7, 2001

(65) Prior Publication Data

US 2003/0207734 A1 Nov. 6, 2003

(51) Int. Cl.
*A63B 22/06* (2006.01)

(52) U.S. Cl. ..... 482/63; 482/6; 482/9

(58) Field of Classification Search ..... 482/4–9, 482/51, 57, 63, 1, 2, 6, 723, 62, 900, 902, 482/908

See application file for complete search history.

(56) References Cited

U.S. PATENT DOCUMENTS

| | | | | |
|---|---|---|---|---|
| 4,233,844 | A | 11/1980 | Dreisinger et al. | |
| 4,601,467 | A | 7/1986 | Gvoich et al. | |
| 4,628,910 | A | 12/1986 | Krukowski | |
| 4,865,315 | A | 9/1989 | Paterson et al. | |
| 4,878,663 | A | 11/1989 | Luquette | |
| 4,930,770 | A * | 6/1990 | Baker | 482/95 |
| 4,976,424 | A | 12/1990 | Sargeant et al. | |
| 4,976,426 | A | 12/1990 | Szabo et al. | |
| 5,011,142 | A * | 4/1991 | Eckler | 482/5 |
| 5,027,303 | A | 6/1991 | Witte et al. | |
| 5,207,216 | A | 5/1993 | Sweeny | |
| 5,240,417 | A | 8/1993 | Smithson et al. | |
| 5,242,348 | A | 9/1993 | Bates | |
| 5,267,925 | A | 12/1993 | Boyd | |
| 5,314,390 | A | 5/1994 | Westing et al. | |
| 5,328,429 | A | 7/1994 | Potash et al. | |
| 5,374,193 | A | 12/1994 | Trachtman | |

(Continued)

FOREIGN PATENT DOCUMENTS

| | | |
|---|---|---|
| EP | 0 194 399 A1 | 9/1986 |

(Continued)

OTHER PUBLICATIONS

Office Action, U.S. Appl. No. 10/650,455, mailed Aug. 8, 2005.

(Continued)

*Primary Examiner*—Loan H Thanh
*Assistant Examiner*—Tam Nguyen
(74) *Attorney, Agent, or Firm*—McDonnell Boehnen Hulbert & Berghoff LLP

(57) ABSTRACT

A method and apparatus for increasing locomotor muscle size and strength at low training intensities using eccentric ergometry.

7 Claims, 8 Drawing Sheets

U.S. PATENT DOCUMENTS

| | | | | | |
|---|---|---|---|---|---|
| 5,410,472 | A | | 4/1995 | Anderson | |
| 5,476,428 | A | | 12/1995 | Potash et al. | |
| 5,583,403 | A | * | 12/1996 | Anjanappa et al. | 318/9 |
| 5,722,937 | A | * | 3/1998 | Smith | 601/23 |
| 5,807,288 | A | | 9/1998 | Wu | |
| 6,152,855 | A | * | 11/2000 | Dean et al. | 482/4 |
| 6,234,939 | B1 | * | 5/2001 | Moser et al. | 482/63 |
| 6,270,445 | B1 | * | 8/2001 | Dean et al. | 482/4 |
| 6,367,352 | B1 | | 4/2002 | Niculescu | |
| 6,456,885 | B1 | | 9/2002 | Shiba et al. | |

FOREIGN PATENT DOCUMENTS

| | | | | |
|---|---|---|---|---|
| EP | 0 255 487 | A2 | * | 7/1987 |
| EP | 0255487 | A2 | * | 7/1987 |
| EP | 0 255 487 | A2 | | 2/1988 |
| EP | 0 255 487 | A2 | * | 3/1988 |
| EP | 1 259 299 | | | 10/2005 |
| JP | 6-104191 | | | 11/1995 |
| JP | 7-344507 | | | 10/1998 |
| JP | 9-301472 | | | 5/1999 |
| JP | 10-178358 | | | 1/2000 |

OTHER PUBLICATIONS

Office Action, U.S. Appl. No. 10/650,455, mailed Mar. 22, 2006.

Office Action, U.S. Appl. No. 11/306,653, mailed Jul. 27, 2007.

Office Action, U.S. Appl. No. 11/306,653, mailed Apr. 28, 2008

Office Action, U.S. Appl. No. 11/306,653, mailed Dec. 8, 2008

J.M. Rooyackers, et al., "Ventilatory Response to Positive and Negative Work in Patients with Chronic Obstructive Pulmonary Disease," Respiratory Medicine (1997) pp. 143-49; copyrighted 1997 W.B. Saunders Company Ltd.

K. Klausen and H.G. Knuttgen, "Effect of Training on Oxygen Consumption in Negative Muscular Work," received Apr. 19, 1971 from the Gymastikteoretisk laboratorium, University of Copenhagen, Denmark, Acta physiol. scand. 1971, pp. 319-323.

Paavo V. Komi and Jukka T. Viitasalo, "Changes in Motor Unit Activity and Metabolism in Human Skeletal Muscle during and after Repeated Eccentric and Concentric Contractions," received Jan. 25, 1977, from the Kinesiology Laboratory, Department of Biology of Physical Activity, University of Jyvaskyla, Finland, Acta physiol. scand. 1977, pp. 246-254.

B.C. Abbott and Brenda Bilgand, "The Effects of Force and Speed Changes on the Rate of Oxygen Consumption During Negative Work," received Aug. 21, 1952, from the Departments of Biophysics and Physiology, University College, London, J. Physiol. (1953), pp. 319-325.

Jan Friden, "Changes in Human Skeletal Muscle Induced by Long-Term Eccentric Exercise," Cell and Tissue Research, copyrighted Springer-Verlag 1984, pp. 365-372.

* cited by examiner

METHOD AND APPARATUS FOR TORQUE-CONTROLLED ECCENTRIC EXERCISE TRAINING

STATEMENT REGARDING FEDERALLY SPONSORED RESEARCH OR DEVELOPMENT

Financial assistance for this project was provided by the U.S. Government through the National Science Foundation under Grant Number IBN9714731; and the United States Government may own certain rights to this invention.

FIELD OF THE INVENTION

The present invention relates, generally, to a method and apparatus for increasing locomotor muscle size and strength at low training intensities and, more particularly, to a method and apparatus for increasing locomotor muscle size and strength at low training intensities by utilizing eccentric ergometry.

BACKGROUND OF THE INVENTION

It is commonly accepted that at least minimal physical activity is necessary to maintain muscle mass. If such minimal activity is lacking, the muscular system becomes atrophied and muscle mass diminishes. Muscular activity is energetically consuming, i.e. oxygen consumption by the muscular system increases heavily during physical activity. For example, oxygen consumption for a healthy person at rest may increase 10-15 times with physical activity. If an adequate amount of oxygen fails to reach the muscle, physical activity will be limited. Inadequate oxygen delivery may be due to a disorder in oxygen reception in the lungs or to insufficient transport of the oxygen to the muscles. Insufficient pumping of the heart is designated heart insufficiency. Muscle reduction begins in those with heart disease as a result of insufficient activation of the heart muscles. This in turn leads to a further reduction of the pumping performance of the heart thereby resulting in circulus vitiosus. The present invention can be used to interrupt this process or condition.

Strength gains occur when muscle produces force. If the muscle shortens while producing force, it produces concentric (Con) positive work. If it lengthens while producing force, work is done on the muscle resulting in eccentric (Ecc) negative work. A muscle action is designated "concentric" if the force of a muscle overcomes an applied resistance and a muscle action is designated "eccentric" if the muscle force is less than the applied resistance. "Acceleration work" results from concentric contractions and "deceleration work" results from eccentric contractions. For example, one may imagine that ascending a mountain requires exclusively concentric work and that descending the same mountain requires mostly only eccentric work: From a physical point of view, equal energy is converted in both cases. In ascending, potential energy is gained while in descending, the same amount of energy is lost. Although physically the same energy amounts are converted, the amount of energy to be spent by the muscular system for ascending is much higher than the amount of energy lost in descending. Five to seven times more energy is spent for concentric work as is spent for physically equal eccentric work.

The magnitude of strength gains seems to be a function of the magnitude of the force produced regardless of its Ecc or Con work. Ecc training has the capability of "overloading" the muscle to a greater extent than Con training because much greater force can be produced eccentrically than concentrically. Accordingly, Ecc training can result in greater increases in strength.

Furthermore, the Ecc mode of contraction has another unique attribute. The metabolic cost required to produce force is greatly reduced; muscles contracting eccentrically get "more for less" as they attain high muscle tensions at low metabolic costs. In other words, Ecc contractions cannot only produce the highest forces in muscle vs. Con or isometric contractions, but do so at a greatly reduced oxygen requirement ($Vo_2$). This observation has been well-documented since the pioneering work of Bigland-Ritchie and Woods (*Integrated eletromyogram and oxygen uptake during positive and negative work,* Journal of Physiology (Lond) 260: 267-277, 1976) who reported that the oxygen requirement of submaximal Ecc cycling is only ⅙-⅐ of that for Con cycling at the same workload.

Typically, single bouts of Ecc exercise at high work rates (200-250 W for 30-45 minutes) result in muscle soreness, weakness, and damage in untrained subjects. Therefore, the common perception remains that Lcc muscle contractions necessarily cause muscle pain and injury. Perhaps because of this established association between Lcc contractions and muscle injury, few studies have examined prolonged exposure to Ecc training and its effect on muscle injury and strength. Nonetheless, Ecc contractions abound in normal activities such as walking, jogging, descending/walking down any incline, or lowering oneself into a chair to name just a few. Obviously, these activities occur in the absence of any muscular damage or injury.

Accordingly, there is a need for providing chronic Ecc training techniques and/or apparatus that can improve locomotor muscle strength without causing muscle injury.

SUMMARY OF THE INVENTION

Because muscles contracting eccentrically produce higher force, and require less energy to do so, Ecc training possesses unique features for producing both beneficial functional (strength increases) and structural (muscle fiber size increases) changes in locomotor muscles. For example, because Ecc work can over load muscle at $Vo_2$ levels that have little or no impact on muscle when the work is performed concentrically, then strength and muscle size increases might be possible in patients who heretofore have difficulty maintaining muscle mass due to sever cardiac and respiratory limitations.

The present invention is directed to a device for applying torque-controlled eccentric training to a human muscular system and includes means for applying a torque transfer to the human muscular system, display means for displaying deceleration power data produced by the muscular system in resisting the torque transfer, and means for detecting and processing deceleration data for adjusting the torque transfer to the human muscular system. In one aspect of the invention, the means for applying a torque transfer includes a drive motor coupled to a turning or pedal crank. The drive motor may also be controlled by a controller that can also be optionally coupled to the display means. The controller operates conditions of the drive motor and can comprise a computer program that can process measured motor data and variables measured by the means for detecting and processing the deceleration data with algorithms for obtaining operating conditions of the drive motor.

In another aspect of the invention, the device may also include at least one flywheel positioned between the drive motor and the turning crank.. The drive motor can be connected to the turning crank by one or more chains which could also take the form of toothed belts or a cardan shaft. The device may also include at least one idler between the drive motor and the flywheel.

In still another aspect of the invention, the device includes an adjustable seat which is connected to a solid frame along with the drive motor and turning crank in order to stabilize the device. There may also be an on/off switch for the drive motor located near the adjustable seat so that a user can switch the device on and off from a user's seated position for training.

The present invention also includes a method for torque-controlled eccentric exercise training using the previously described device which includes selecting operation parameters at the turning crank, processing measured data that is detected; monitoring operation conditions of the drive motor; displaying produced deceleration power and operation parameters at the turning crank on a display device; and controlling the drive motor according to selected operation conditions.

BRIEF DESCRIPTION OF THE DRAWING FIGURES

The present invention will hereinafter be described in conjunction with the appended drawing figures, wherein like numerals denote like elements, and:

Figure 1:
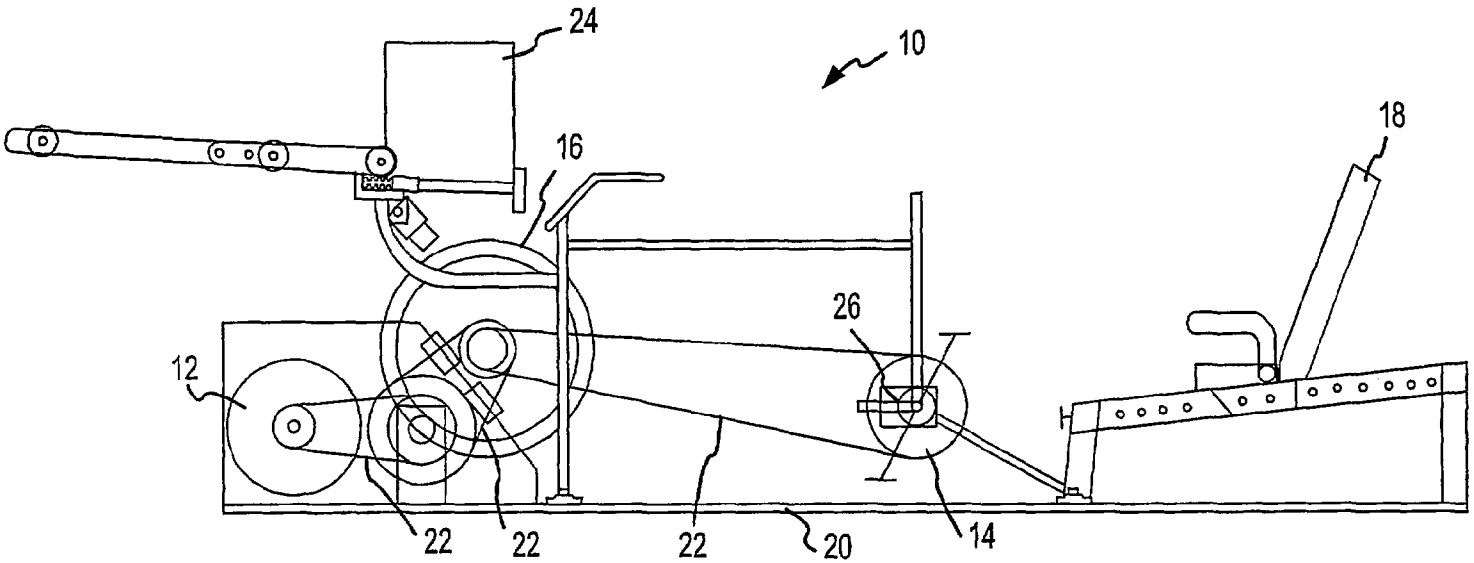
FIG. 1 is a side elevational and partial cross-sectional view of an eccentric ergometer in accordance with the present invention.
Figure 2:
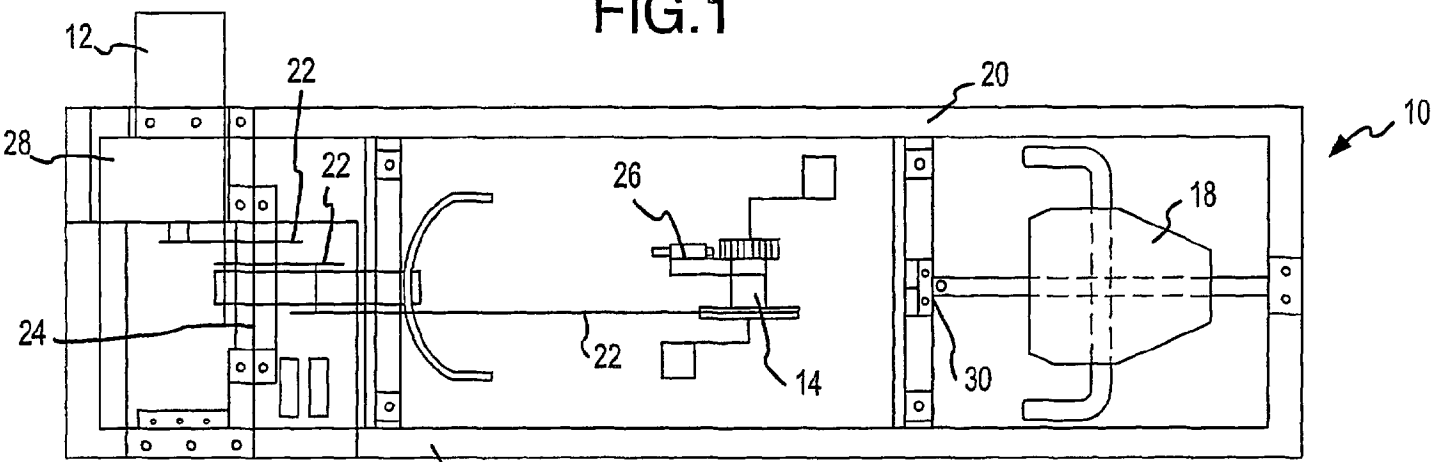
FIG. 2 is a top elevational view of the eccentric ergometer shown in FIG. 1 in accordance with the present invention.
Figure 11:
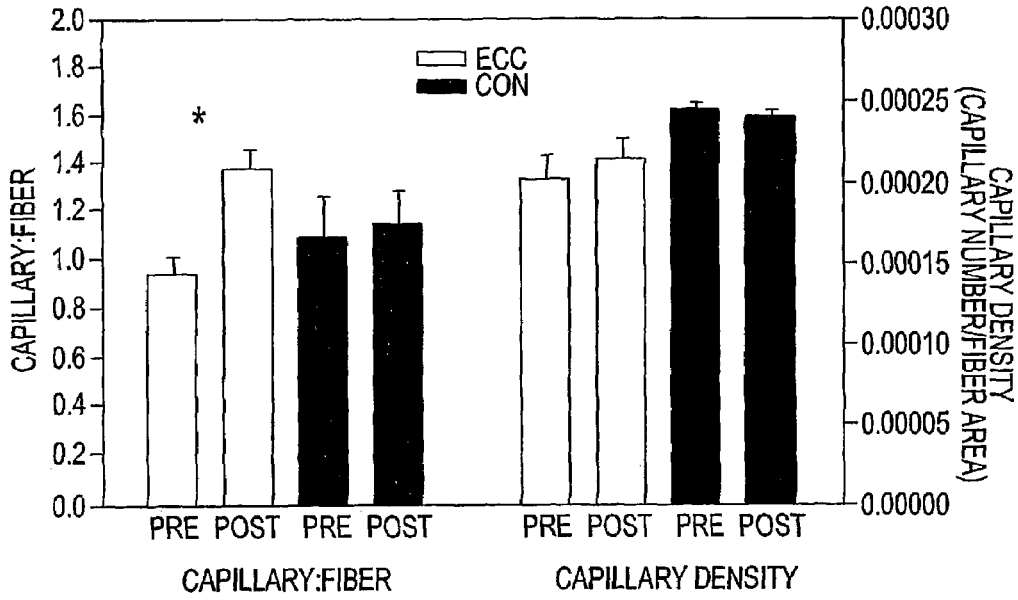
Figure 12:
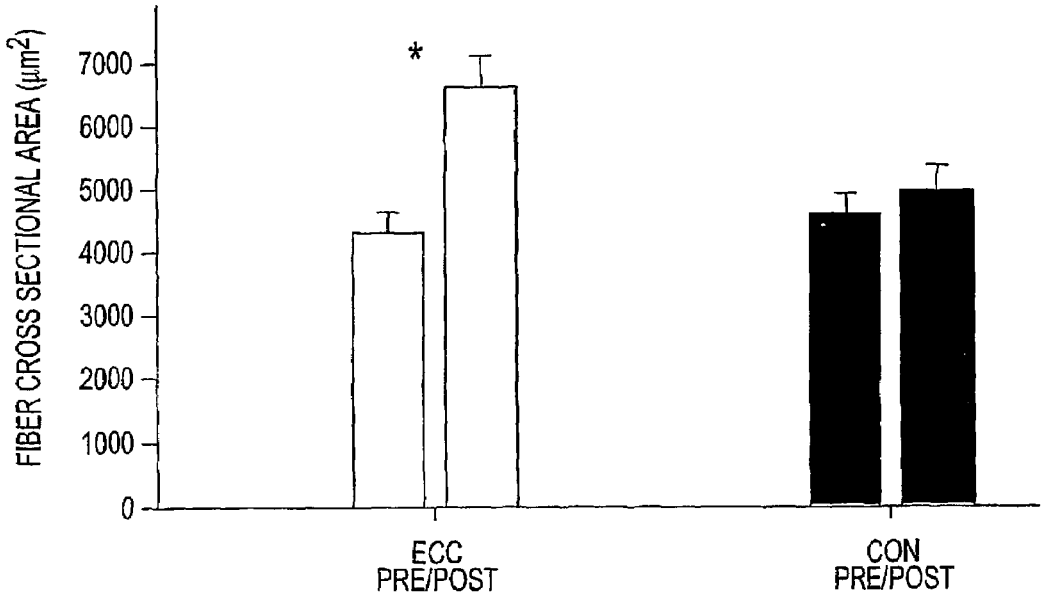

FIG. 11 is a bar graph comparing capillary fiber cross-sectional areas both before and after an eight week training period using a traditional concentric ergometer and the eccentric ergometer shown in FIGS. 1-2; and FIG. 12 is a bar graph comparing capillary-to-fiber ratio and capillary density both before and after an eight week training period using a traditional concentric ergometer and the eccentric ergometer. shown in FIGS. 1-2.

DETAILED DESCRIPTION OF EXEMPLARY EMBODIMENTS

The present invention is directed to a method and apparatus for increasing locomotor muscle size and strength at low training intensities utilizing eccentric ergometry. The apparatus of the present invention comprises means for applying a torque transfer to the human muscular system. The apparatus is directed to an eccentric ergometer device 10, shown in FIGS. 1-2, which includes a motor 12, a turning or pedal crank 14, at least one flywheel 16, and an adjustable seat 18. The motor 12, turning crank 14, and seat 18 are all coupled to a frame 20, preferably comprised of steel, to aid in stabilizing the device 10. The motor 12 is mechanically coupled to the turning crank 14 by one or more chains 22 which may also take the form of toothed belts or cardan shafts. The device 10 further comprises display means 24, such as a monitor, for displaying deceleration power data produced by a user's muscular system in resisting torque transfer. A magnetic sensor 26 monitors pedal speed.

In constructing the eccentric ergometer device 10, the power train of a standard cycle ergometer (e.g., a MONARCH® cycle ergometer) may be used. The adjustable seat 18 may comprise a recumbent seat and the device 10 may be driven, for example, by a three-horsepower direct current (DC) motor with one or more idlers between the motor 12 and the flywheel 16. The gear ratio from the flywheel 16 to the turning or pedal crank 14 is preferably about 1:3.75. As previously stated, all components are mounted to a steel frame 20 for stability. A motor controller 28 controls the motor speed and preferably has a 0 to 10 Volt output for both motor speed and load. The magnetic sensor 26 monitors pedal revolutions per minute (rpm) which is preferably displayed to the rider/user during the training session. The voltage and amperage outputs from the controller 28 are monitored through an analog-to-digital board and dedicated computer. The motor 12 also includes an on/off switch 30 which is accessible by a user in order to switch the device on and off from the position of use. A safety shut off may also be included which may be programmed to automatically shut off the motor once certain predetermined parameters are reached.

The ergometer device 10 can be calibrated by using the original standard ergometers friction band and applying known loads (via weights) as the motor 12 moves the flywheel 16 in a forward direction at a fixed rpm and reading the amperage/voltage of the motor. Therefore, for a fixed load and rpm, the calibration performed in the forward direction also serves to calibrate the reverse direction of the flywheel. Accordingly, the Ecc work rate is maintained by a user resisting the pedal motion at a fixed rate.

Figure 3:
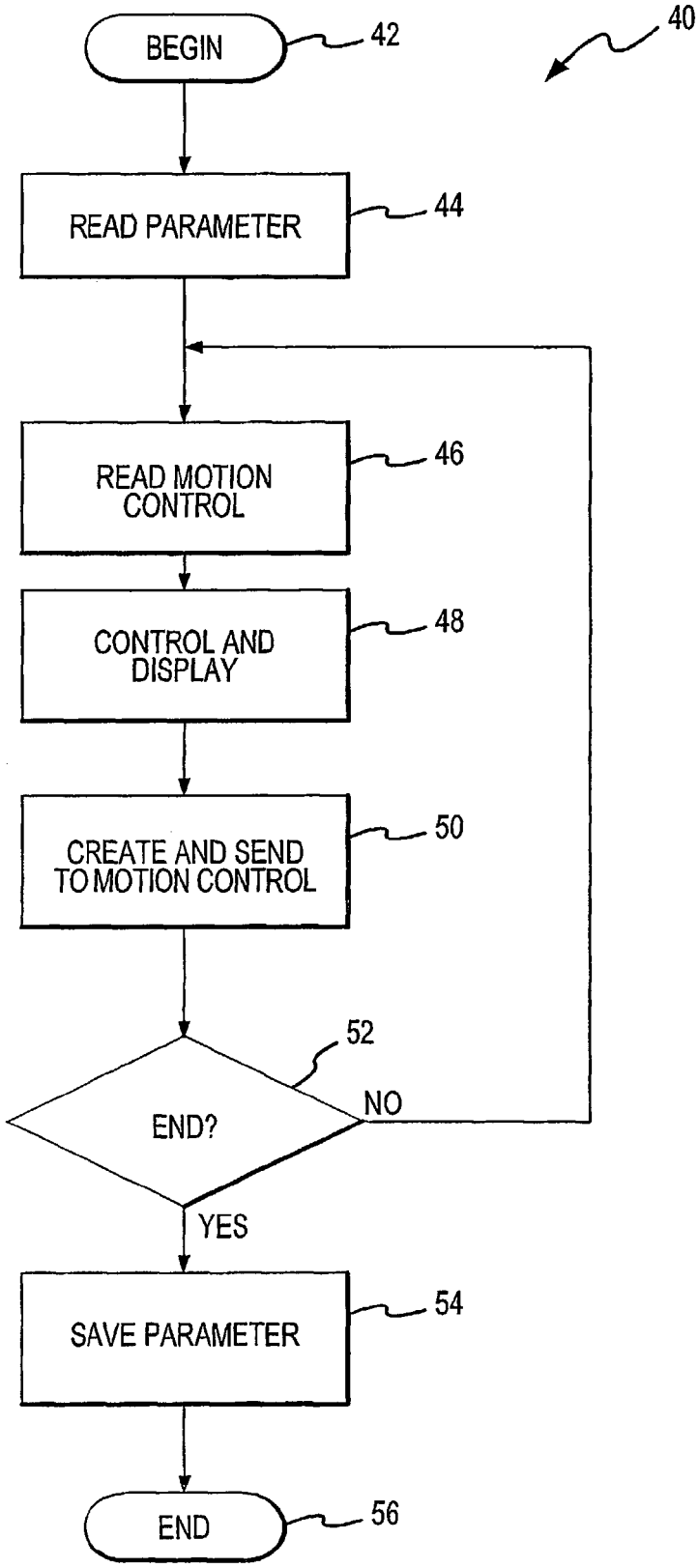
FIGS. 3-4 are flowcharts showing a method for torque-controlled eccentric exercise training using the eccentric ergometer shown in FIGS. 1-2.
Figure 4:
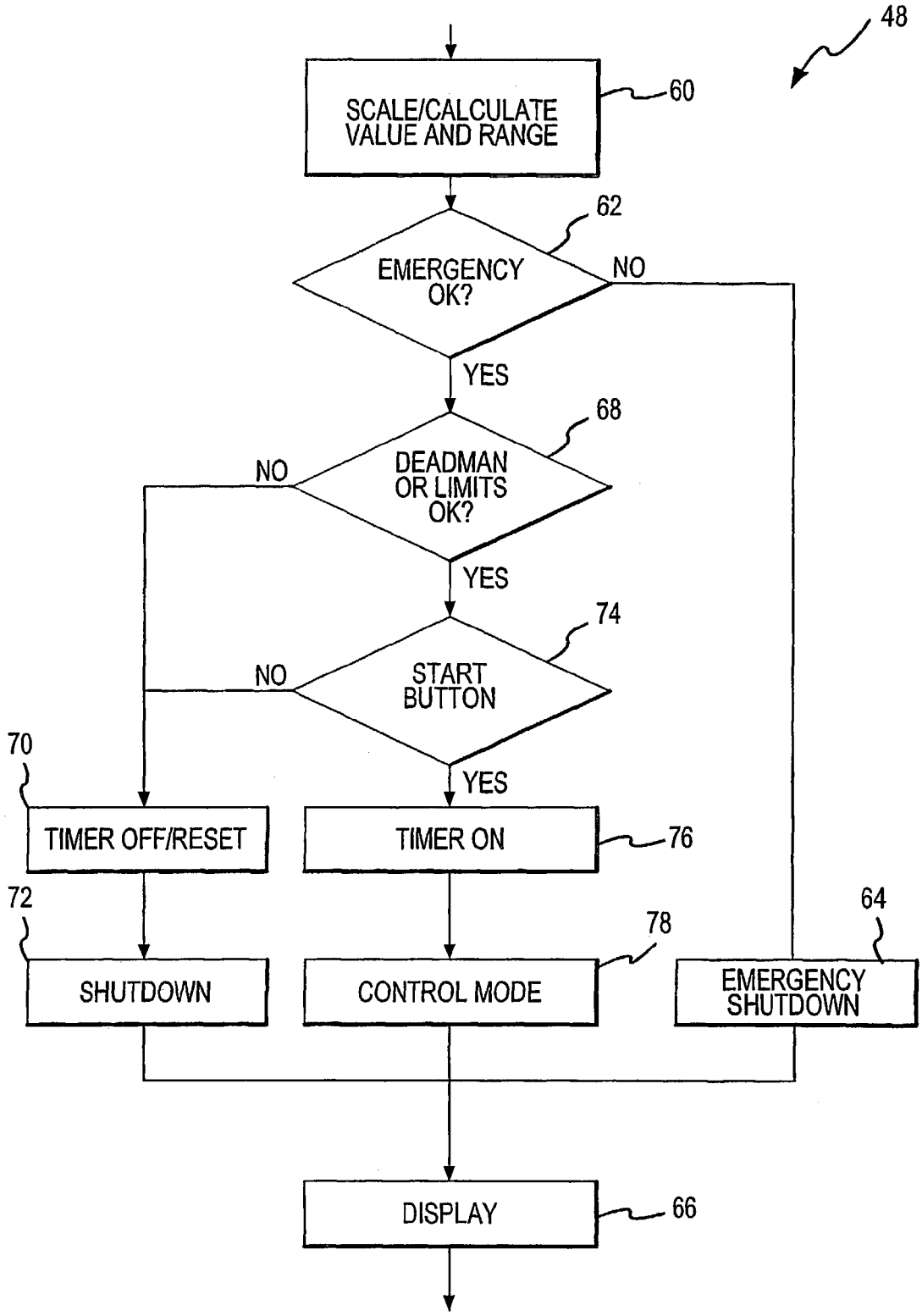

FIGS. 3-4 are flowcharts showing a method for torque-controlled exercise training 40 using the eccentric ergometer device 10 shown in FIGS. 1-2. The method 40 is preferably carried out by a software program that controls the functioning of the eccentric ergometric device 10. The method starts by beginning a training session in step 42 and one or more first parameters are read in step 44. The motion control of the device 10 is read in step 46 and a user may then control and display specific parameters for the functioning of the device 10 in step 48. Once the desired controls are displayed in step 48, the program recipe is created and sent to the motion control for the device in step 50. Once the user has trained or practiced at the desired setting for a desired time period (programmed recipe), the user determines whether or not to end the training session in step 52. If the user elects to end the previously programmed training session, the user may then return to step 46 to read the motion control and continue on through steps 48-50 to train on another set of preprogrammed parameters. Alternatively, if the user elects to end the training session in step 52, the parameters of the training session can be saved in step 54 and the training session then ends in step 56.

Turning now to FIG. 4, there is shown a flowchart which depicts a more detailed procedure for the control and display step 48 in FIG. 3. The first step in controlling and displaying parameters for a training session involves calculating the values and ranges of parameters in step 60 that are required to achieve certain desired outcomes. In step 62, a determination is made as to whether or not an emergency shut off is appropriate. If so, an emergency shutdown takes place in step 64 which is then reflected by displaying the same in display step 66. If there is no emergency in step 62, a determination is made in step 68 as to whether the limits set for the training program are acceptable. If the limits are not acceptable, the timer is shut off and reset in step 70 and the training session is shutdown in step 72. This shutdown in step 72 is then displayed in display step 66. If the limits set for the training session are acceptable, a user determines whether or not to press the start button in step 74. If the start button is not pressed in step 74, the timer is shut off and reset in step 70 and the training session is shutdown in step 72. Again, this shutdown in step 72 is displayed in display step 66. Alternatively, if the user elects to press the start button in step 74, the timer is turned on in step 76 and the training session enters the control mode in step 78. The control mode is then displayed in display step 66.

Examples of Training Regimens Used With Eccentric Ergometer Device of the Present Invention Six Week Training Regimen:

Subjects and training regimen: Nine healthy subjects 18-34 (mean 21.5) years old were assigned at random to one of two exercise training groups: 1) an Ecc cycle ergometer like that shown in FIGS. 1-2, two males (1 sedentary, 1 regular moderate exerciser) and two females (1 regular moderate exerciser, 1 competitive triathlete), or 2) traditional Con ergometer, two irregularly exercising males and three light exercising females. Both the Ecc and Con groups trained for six weeks with a progressively increasing frequency and duration of training (and a pedal rpm of 50-60). During the first week, each group trained two times for 10-20 minutes. Both groups then exercised three times during the second week for 30 minutes and finally five times per week for 30 minutes during the third-sixth weeks. During the first four weeks, the Ecc group began with threefold greater work rates than the Con group. During the fifth week, work rates were adjusted in an attempt to equalize $Vo_2$ between the groups.

Measurements: To assess skeletal muscle strength changes, maximal voluntary isometric strength produced by the knee extensors was measured with a Cybex dynamometer before, after and during training. $Vo_2$ was measured once a week while training with an open spirometric system with subjects wearing a loose fitting mask. A visual analog scale (VAS) was used to determine the perception of lower extremity muscle soreness. Subjects were asked to report a rating of perceived exertion (RPE) on a scale rating.

Figure 6:
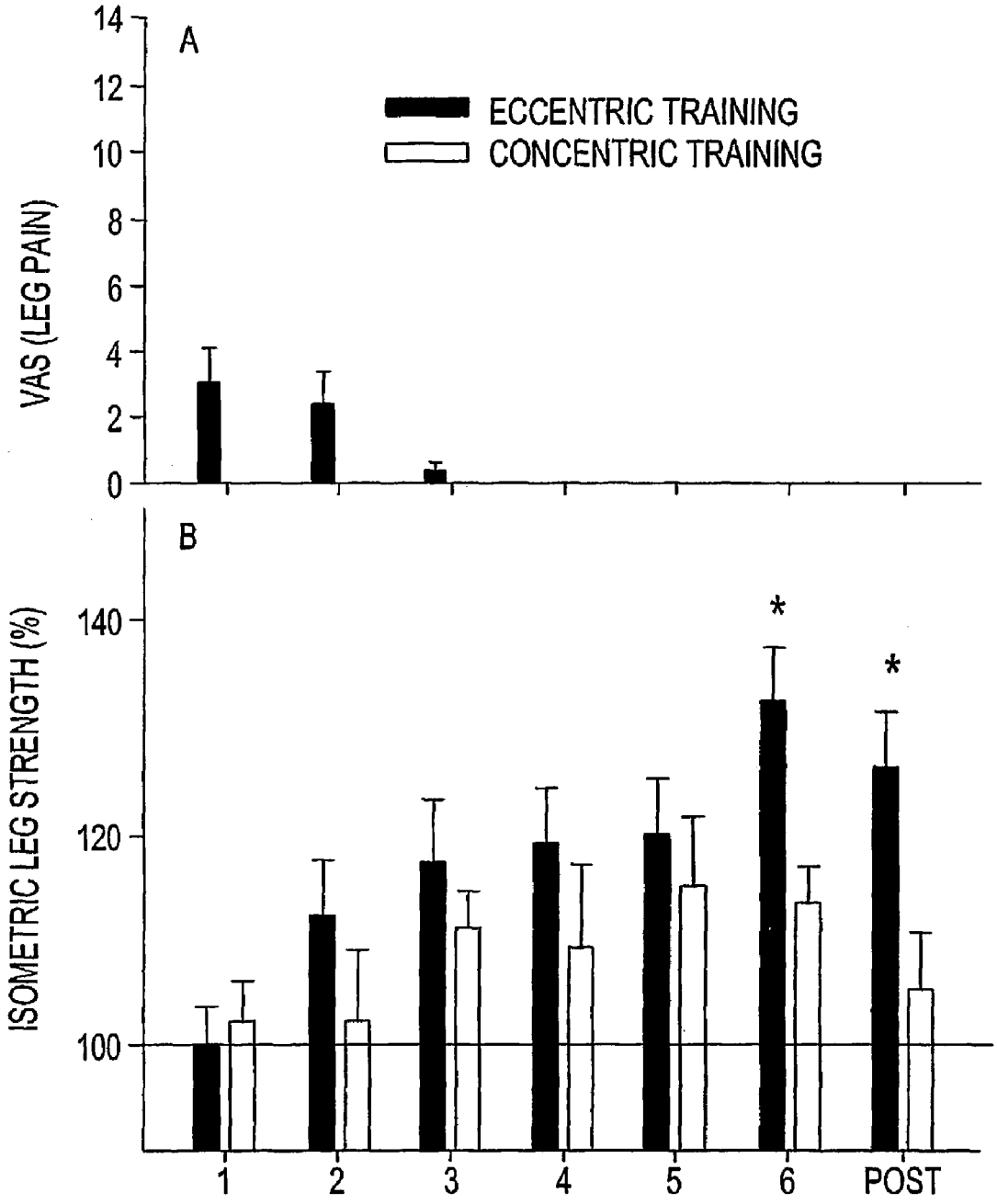
FIG. 6 is a bar graph comparing leg pain and isometric leg strength measurements both during and after a six week training regimen using a traditional concentric ergometer and the eccentric ergometer shown in FIGS. 1-2.

The results of the study demonstrated that if the Ecc work rate is ramped up during the first four weeks and then maintained for at least two weeks, strength gains can be made with minimal muscle soreness and without muscle injury as noted by the VAS and no loss in leg strength at any time during the study. In fact, leg strength increased significantly in the Ecc group. (See FIG. 6). Progressive ramping of the Ecc work prevented nearly all of the typical or expected muscle injury and eliminated all muscle soreness associated with the first few weeks of Ecc training. Despite efforts to equalize the exercising $Vo_2$ by altering work rates, Ecc was less than Con throughout the fifth week of training and not equalized until the sixth week. gains in leg strength were noted with the Ecc training group whereas no strength changes occurred with the Con group.

Figure 5:
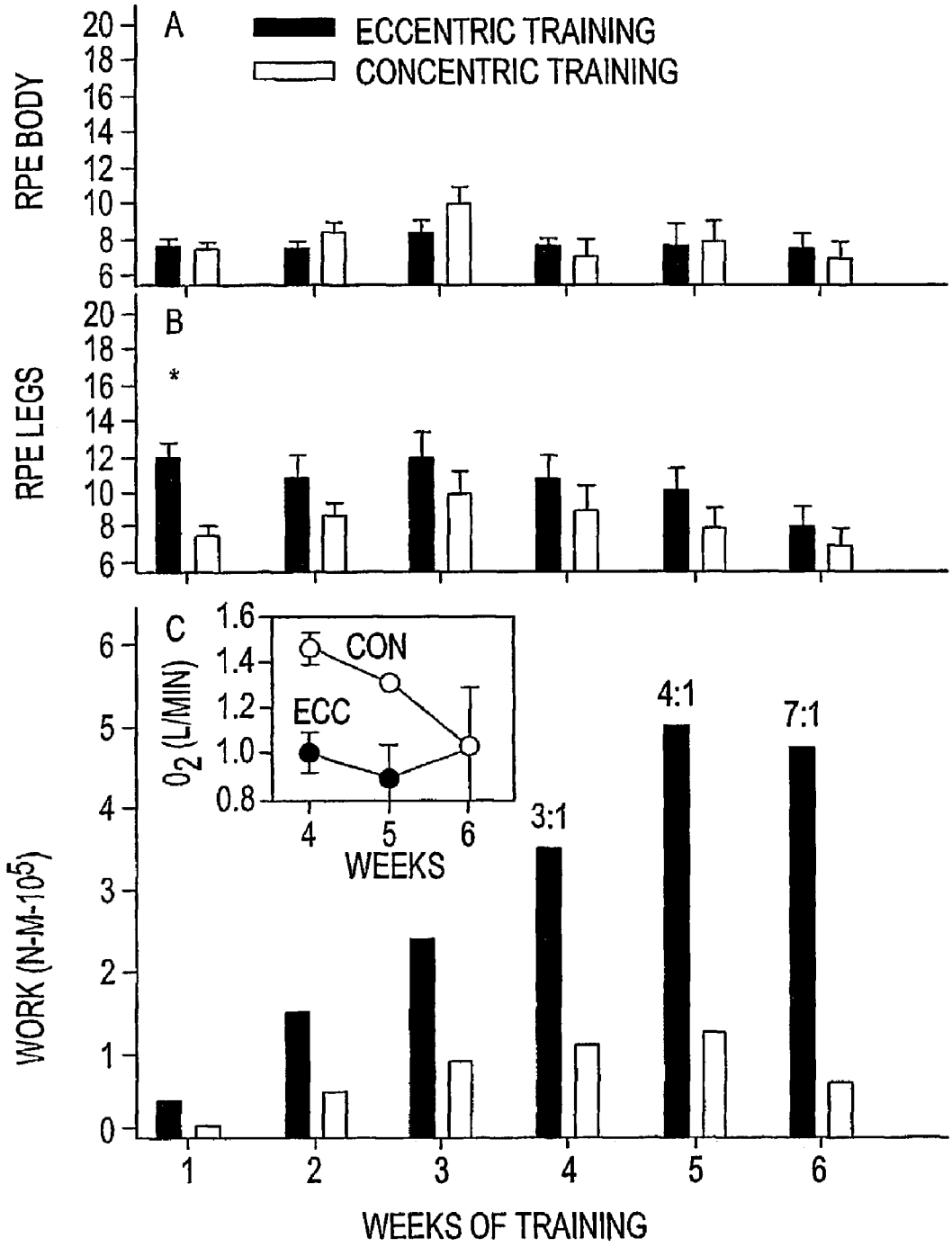
FIG. 5 is a bar graph comparing whole body and leg exertion measures and total work and oxygen costs during a six week training regimen using a traditional concentric ergometer and the eccentric ergometer shown in FIGS. 1-2.

With respect to FIG. 5, the only significant differences noted in perceived body and leg exertion were in the RPE (legs) during the first week of training when the Ecc group had a greater perceived leg exertion.

The strength enhancements using the method and apparatus of the present invention, with very minimal cardiac demand, may have profound clinical applications. Despite improvements in strength and muscle mass with high-intensity resistance training in healthy elderly, many with cardiovascular disease cannot exercise at intensities sufficient to improve skeletal muscle mass and function. Exercise intensity in this population is often severely limited by the inability of the cardiovascular system to deliver adequate oxygen to fuel muscles at levels significantly above resting. For many elderly patients, the symptom inducing metabolic limits have been estimated as low as 3 METS which is equivalent to con cycling at approximately 50 W on an ergometer. Such work rates may be insufficient to adequately stress muscle and prevent muscle atrophy and the concomitant functional decline. This group of patients with chronic heart failure and/or obstructive pulmonary disease could maintain their muscle mass and potentially even experience an increase in muscle strength during their exercise rehabilitation by using the method and apparatus of the present invention.

Eight Week Training Regimen:

Subjects and training regimen: Fourteen healthy male subjects with a mean age of 23.9 years (range, 19-38 years) were systematically grouped to create two groups of seven subjects, each with an equivalent mean peak oxygen consumption ($Vo_{2peak}$). the two groups were assigned at random to one of the following two groups: 1) an Ecc cycle ergometer like that shown in FIGS. 1-2 or 2) a traditional Con cycle ergometer. After two weeks of training, one subject in the Con group dropped out leaving n=7 for the Ecc group and n=6 for the Con group.

Figure 7:
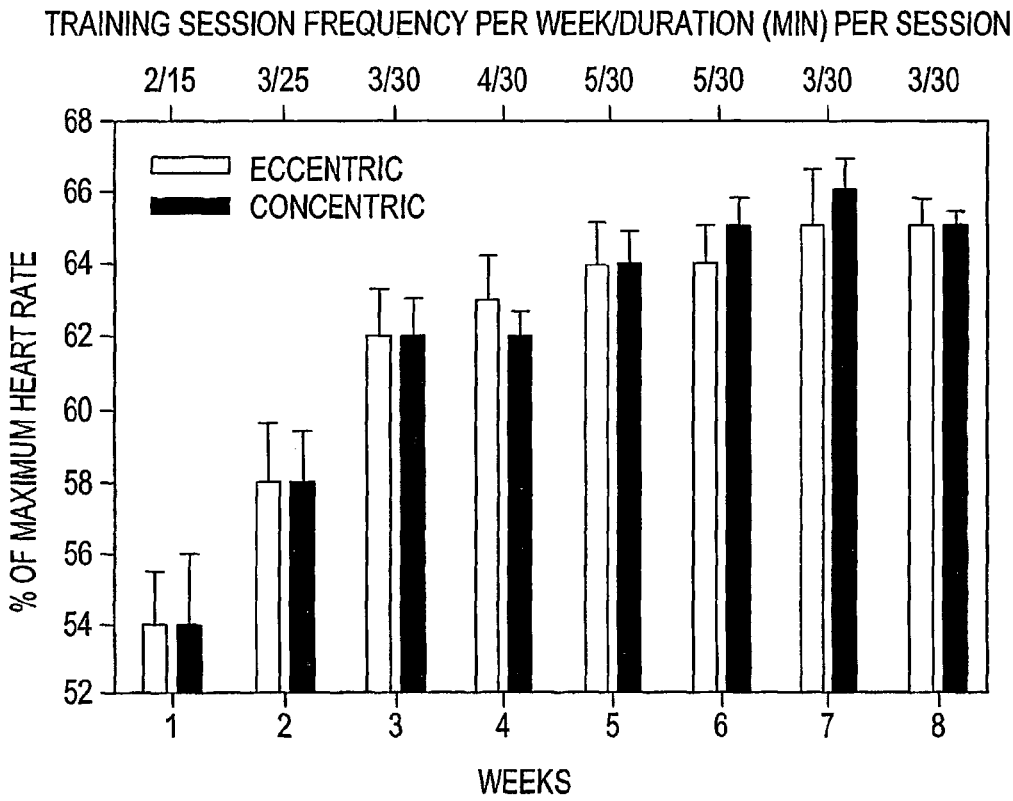
FIG. 7 is a bar graph comparing eccentric and concentric training intensities measured by maximum heart rate during an eight week training period using a traditional concentric ergometer and the eccentric ergometer shown in FIGS. 1-2.

Each subject performed a $Vo_{2peak}$ test on a traditional Con ergometer and the subject" peak heart rate ($HR_{peak}$) was defines as the heart rate obtained at $Vo_{2peak}$. Training exercise intensity was set to a fixed and identical percentage of $HR_{peak}$ ($\%HR_{peak}$) in both groups of subjects and heart rate was monitored over every training session for the 8 weeks of training. $\%HR_{peak}$ was progressively ramped for both groups in an identical fashion during the training period, from an initial 54% to a final 65% $HR_{peak}$. (See FIG. 7). The training period extended for eight weeks with a progressively increasing frequency and duration of training. During week 1, all subjects rode 2 times/wk for 15 minutes. Training frequency was 3 times per week for weeks 2 and 3 at 25-30 minutes, 4 times/week at 30 minutes for week 4, and 5 times/week for 30 minutes during weeks 5 and 6. The frequency of training was decreased to 3 times/week; but training duration remained at 30 minutes for weeks 7 and 8 due to the Ecc subjects subjective feeling of "fatigue". Pedal rpm was identical for both groups (started at 50 rpm and progressively increased to 70 rpm by the fifth week).

Measurements: All measurements were the same as the six week training regimen discussed above in addition to the following: Total work (joules) on the Ecc ergometer per training session was calculated by integrating the work rate (watts), determined directly from a 0 to 10 volt output from the motor, which was calibrated to a known work rate, over the total duration of each training session. The total work per training session was calculated on the Con recumbent ergometer by multiplying the work rate displayed on the calibrated ergometer by the duration of each training session. A single needle biopsy from the vastus lateralis at the midthigh level was taken 2 days before the beginning of the study and 1-2 days after the eight week study ended to measure muscle fiber ultrastructure and fiber area. The capillary-to-fiber ratio was determined by counting the number of capillaries and fibers via capillary and fiber profiles from electron micrographs.

Figure 8:
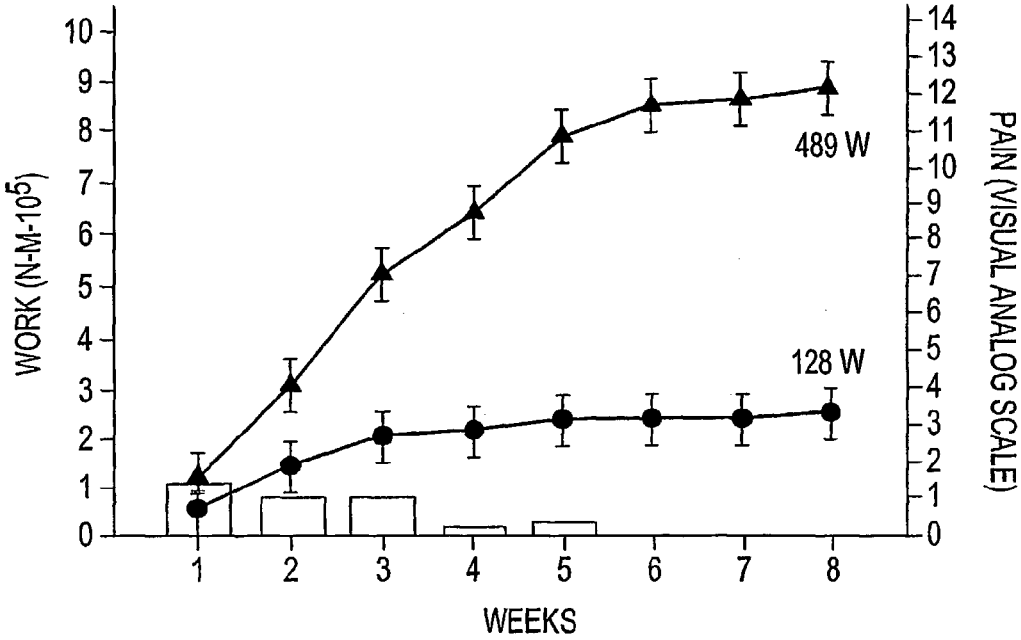
FIG. 8 is a graph comparing the amount of eccentric and concentric work performed during an eight week training period using a traditional concentric ergometer and the eccentric ergometer shown in FIGS. 1-2.
Figure 9:
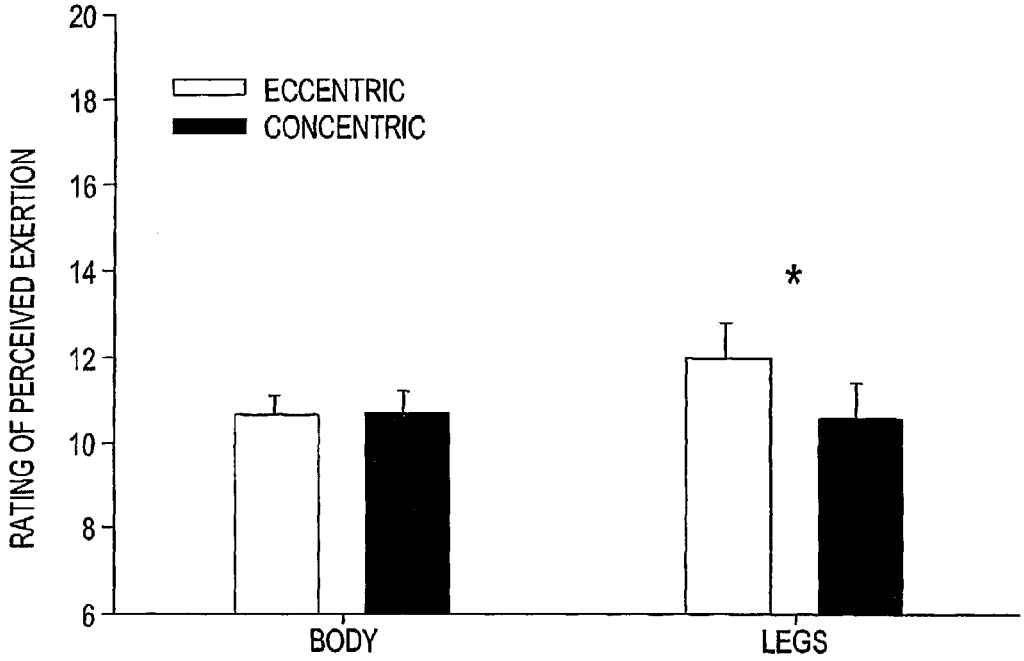
FIG. 9 is a bar graph comparing the rating of perceived exertion for the body and legs using the Borg scale during an eight week training period using a traditional concentric ergometer and the eccentric ergometer shown in FIGS. 1-2.
Figure 10:
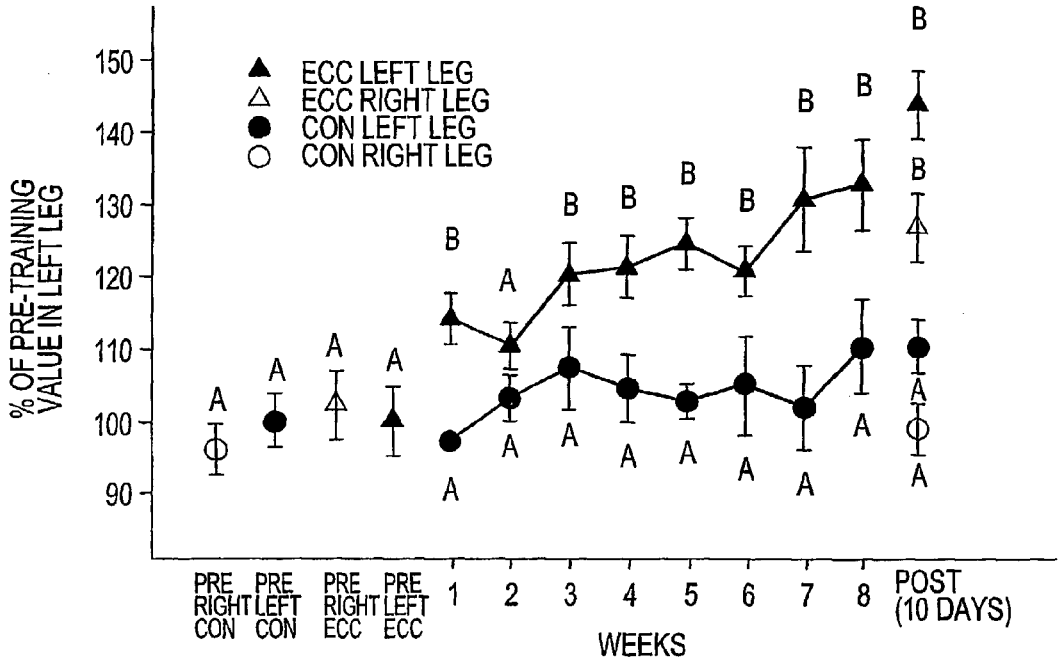
FIG. 10 is a graph comparing isometric knee extension strength changes before, during, and after an eight week training period using a traditional concentric ergometer and the eccentric ergometer shown in FIGS. 1-2.

Ecc and Con cycle ergometry training workloads increased progressively as the training exercise intensity increased over the weeks of training. Both groups exercised at the same $\%HR_{peak}$, and there was no significant difference between the groups at any point during training. But, the increase in work for the Ecc group was significantly greater than the Con group as shown in FIG. 8. Perceived exertion for the body was not significantly different between the Ecc and Con groups but perceived exertion of the legs was significantly greater in the Ecc group over the 8 week training period as shown in FIG. 9. Isometric strength improvements for the left leg were significantly greater every week (except week 2) for the Ecc group as shown in FIG. 10 but no changes in strength were noted in the Con group at any time. There was also a significant right leg/left leg X pre/posttraining interaction for the Ecc group but none for the Con group. Further, as shown in FIG. 11, Ecc fiber area was significantly larger posttraining while no fiber area change was noted for the Con group. Finally, Ecc capillary-to-fiber ratio significantly increased posttraining (47%), paralleling the increase noted in fiber cross-sectional area, whereas the Con group did not. (See FIG. 12).

This study demonstrates that if the training exercise intensity is ramped up and equalized for both groups over the first 5 weeks and then maintained for three additional weeks, then large differences in muscle force production, measured as total work, result comparing the Ecc and Con groups. This increased force production in the Ecc group apparently stimulated significant increases in isometric strength and fiber size, neither of which occurred in the Con group.

The method and apparatus of the present invention enable an Ecc skeletal muscle paradigm that can be used in clinical settings to deliver greater stress to locomotor muscles (workloads exceeding 100 W), without severely stressing the oxygen delivery capacity of the cardiovascular system. Patients with chronic heart failure and/or obstructive pulmonary disease could at least maintain their muscle mass and perhaps even experience an increase in muscle size and strength using the method and apparatus of the present invention.

The foregoing description is of exemplary embodiments of the subject invention. it will be appreciated that the foregoing description is not intended to be limiting; rather, the exemplary embodiments set forth herein merely set forth some exemplary applications of the subject invention. It will be appreciated that various changes, deletions, and additions may be made to the components and steps discussed herein without departing from the scope of the invention as set forth in the appended claims.

The invention claimed is:

1. A device for applying torque-controlled eccentric exercise to a human muscular system comprising:

a) a frame and a drive motor, supported on the frame, for turning a turning crank in a first direction at a constant speed for applying a torque transfer to the human muscular system, wherein the turning crank includes a pedal capable of 360 degree rotation about an axis and the drive motor is an electric motor having a controllable number of revolutions and capable of being switched on and off;

b) means for displaying deceleration power data produced by application of force by the muscular system in a direction opposite that of said first direction in resisting the torque transfer the display means being coupled to the frame;

c) means for sensing and processing said deceleration data for adjusting said torque transfer in real time to the human muscular system the sensing and processing means being coupled to the frame;

d) a controller for the drive motor optionally coupled to the display means, wherein the controller controls operating conditions of the drive motor thereby controlling at least one of a number of revolutions of the turning crank, an amount of the torque transfer, and an emergency stop of the driving-motor at predetermined torque values of the turning-crank; and e) a computer program in communication with the controller, wherein the computer program is capable of:

i) receiving and processing sensed deceleration power data produced by the human muscular system in resisting the torque transfer;

ii) selecting parameters and parameter levels based upon deceleration power data to achieve a desired outcome; and iii) controlling, via the controller, in accordance with the sensed deceleration power data and selected parameters and parameter levels a desired constant rpm of the drive motor to maintain the constant speed.

2. The device of claim 1 wherein said display means further displays the operating conditions of the drive motor.

3. The device of claim 1 wherein said drive motor is mechanically coupled to said turning crank by at least one or more of a chain, a toothed belt, or a cardan shaft.

4. The device of claim 1 comprising at least one fly wheel arranged between said drive motor and said turning crank to ensure an even movement of said turning crank.

5. The device of claim 4 further comprising at least one idler positioned between the drive motor and the flywheel.

6. The device of claim 1 further comprising an adjustable seat for a user to occupy while the torque transfer is being applied to the human muscular system.

7. The device of claim 6 wherein the drive motor, the turning crank, and the seat are rigidly coupled to one another.

* * * * *